US005411153A

United States Patent [19]

Unfried

[11] Patent Number: 5,411,153

[45] Date of Patent: May 2, 1995

[54] STORAGE RACK ASSEMBLY SYSTEM

[76] Inventor: Greg J. Unfried, 10830 Sunset Dr., Evansville, Tenn. 47712

[21] Appl. No.: 140,302

[22] Filed: Oct. 22, 1993

[51] Int. Cl.[6] ..... A47B 47/00

[52] U.S. Cl. ..... 211/188; 211/186; 211/194; 108/91; 108/180; 108/193

[58] Field of Search ..... 211/188, 194, 182, 186, 211/187, 191; 108/91, 180, 181, 193, 144

[56] References Cited

U.S. PATENT DOCUMENTS

| | | | |
|---|---|---|---|
| 1,320,982 | 11/1919 | Boyle . | |
| 2,463,124 | 3/1949 | Sims . | |
| 2,914,190 | 11/1959 | Geddes et al. . | |
| 3,596,942 | 8/1971 | Zoebelein | 108/180 X |
| 3,606,023 | 9/1971 | Edmunds . | |
| 3,722,701 | 3/1973 | Malcik et al. | 211/194 |
| 3,739,921 | 6/1973 | Schmidt | 211/194 |
| 3,861,324 | 1/1975 | Silson | 211/188 X |
| 3,954,183 | 5/1976 | Ohlson | 211/186 |
| 4,099,472 | 7/1978 | Kellogg . | |
| 4,158,336 | 6/1979 | Brescia et al. . | |
| 4,403,886 | 9/1983 | Haeusler . | |
| 4,709,640 | 12/1987 | Jouarnin . | |
| 4,940,149 | 7/1990 | Vineis | 211/186 |
| 4,981,224 | 1/1991 | Rushing . | |
| 5,052,565 | 10/1991 | Zachrei | 211/192 X |
| 5,169,009 | 12/1992 | Bomze | 211/187 X |

FOREIGN PATENT DOCUMENTS

| | | | |
|---|---|---|---|
| 955718 | 10/1974 | Canada | 211/194 |
| 2362538 | 12/1973 | Germany . | |
| 184778 | 8/1957 | Sweden . | |
| 2517185 | 12/1981 | Sweden . | |
| 965052 | 11/1962 | United Kingdom . | |

*Primary Examiner*—Blair M. Johnson
*Attorney, Agent, or Firm*—Wenderoth, Lind & Ponack

[57] ABSTRACT

A storage rack assembly system is made up of a plurality of vertical members and a plurality of cross-members supported by the vertical members. The vertical members can be stacked one on top of another and locked together by means of suitable connectors, which connectors are also used to support the cross-members. In a first embodiment of the invention, the connectors are rods on the ends of the cross-members engaging aligned holes extending laterally through connecting portions of the vertical members. In another embodiment, the vertical members are vertically locked to each other by suitable bolts, the bolts providing stepped portions for engaging recesses in shelves extending between the vertical members. The connectors further enable the system to be expanded horizontally as well as vertically.

14 Claims, 5 Drawing Sheets

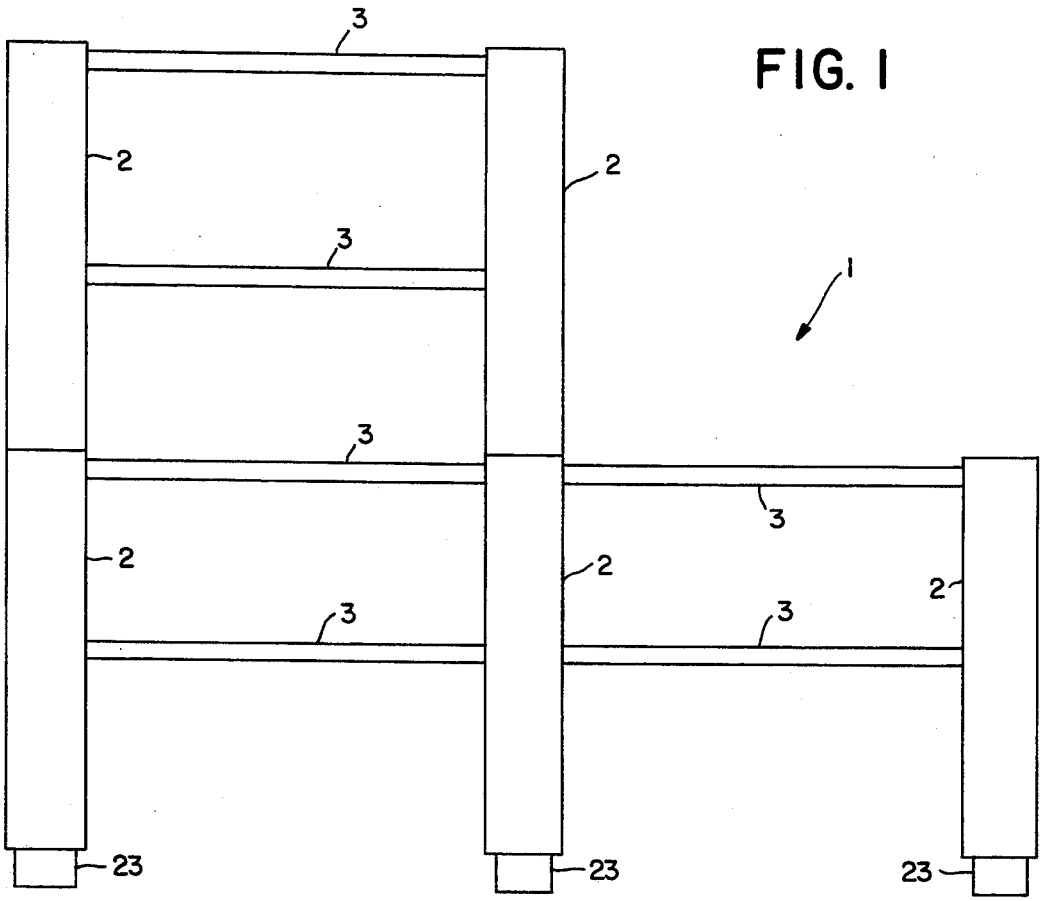
FIG. 1
FIG. 2
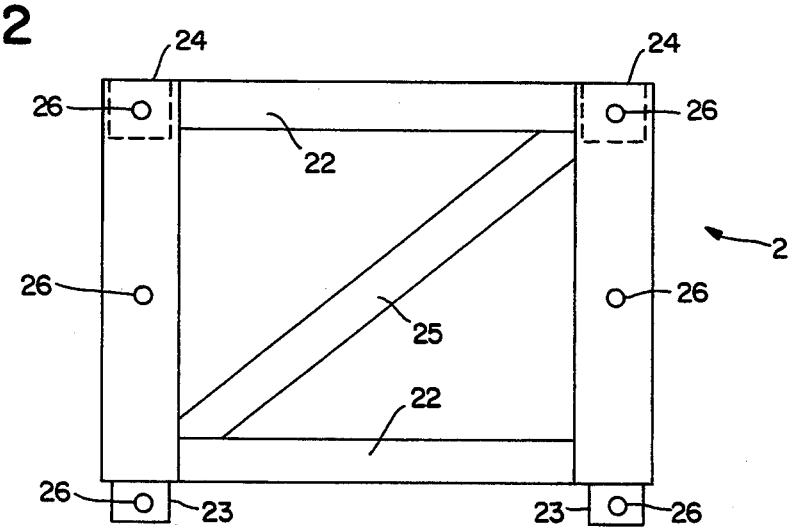

STORAGE RACK ASSEMBLY SYSTEM

BACKGROUND OF THE INVENTION

The present invention relates to a storage rack assembly system that is particularly designed so that a storage rack can be easily and quickly assembled. Further, the storage rack assembly system is preferably easily configurable into different arrangements depending on the desired use.

A known knock shelving system is disclosed in U.S. Pat. No. 4,158,336 to Brescia. The system of Brescia provides a knock down shelving system that employs clip connectors. Vertical members are interfitted in a socket-like arrangement as illustrated in FIG. 6 of that patent, with overlapping holes that are vertically locked to each other by a connector clip 35. The connector clip 35 also extends through a hole 39 on a shelf 11.

Also, U.S. Pat. No. 4,403,886 to Haeusler uses a mortise and tenon type of joint for furniture such as bookcases, shelving and free-standing closets. A central beam having openings therethrough is used to connect vertical members and horizontal members by the use of bolts.

SUMMARY OF THE INVENTION

In the present invention, a storage rack assembly is provided that uses three basic components. The three components include a vertical member, a horizontal cross-member or shelf, and a connector for connecting the cross-member to the vertical members and for connecting two vertical members together.

More particularly, a plurality of vertical members are provided that each have a pair of legs that are interconnected to form a structural unit. A projection is provided at one end of each of the legs and a socket is provided at the opposite end of each leg. The projections of each of the vertical members is adapted to fit into the sockets of another vertical member. Both the projections and the sockets of each vertical member have through holes that extend laterally therethrough and are positioned so as to be alignable when the projections of one vertical member are in the sockets of another vertical member.

Further, the plurality of cross-members are adapted to be horizontally supported between pairs of the vertical members in order to provide a horizontal support surface. A plurality of connectors are provided, the connectors being adapted to be inserted in the through-holes of the sockets and the projections to support the cross-members on the vertical members.

According to a first embodiment of the present invention, the connectors are rods that are integral with the cross-members. Each rod has a length that is no more than one half of the width of a socket in order to allow a socket to be engaged by two cross-members from opposite sides thereof. Each cross-member, further, preferably has a flange that is connected thereto adjacent to each rod thereon, the flange having a bolt hole that extends therethrough that is alignable with similar corresponding bolt holes in the sockets and projections.

According to a second embodiment of the present invention, the cross-members are shelves that are adapted to be horizontally supported between pairs of the vertical members. Each shelf has a plurality of bolt engaging portions thereon. The connectors in this embodiment are then a plurality of bolts that are adapted to extend through the holes in the sockets and projections as well to support these shelves. Each shelf preferably comprises a horizontal surface that has a downwardly extending edge, the bolting engaging portions of the shelves being recesses that are formed in the edges of the shelves.

Further, the bolts being used as the connectors should be longer than the width of the sockets of the vertical members in order to be able to extend completely through the holes that extend laterally through the sockets. Each bolt has a head at one end thereof, with a stepped portion adjacent to the head. The stepped portion has a larger diameter than the holes through the sockets and the projections. A shank is provided adjacent to the stepped portion, the shank having a diameter sized to fit through the holes in the sockets and projections and a threaded end. Further, the bolt is provided with a nut, the nut also comprising a head and having a second stepped portion that is adjacent to the second head, the stepped portion similarly having a larger diameter than the holes through the sockets and the projections. In this way, the stepped portions are provided outside the extent of the holes through the sockets and projections so as to provide a support surface for the shelves.

In a preferred feature of the invention, the heads of the bolt and the nuts are knurled in order to provide an easy gripping surface for manual assembly and disassembly.

Thus, in an actual configuration of the above components, the plurality of vertical members might include a first vertical member having four bolts extending through the holes thereof and a second vertical member having four bolts also extending through its holes. First and second shelves would have their recesses engaging two step portions of bolts on each of the first and second vertical members. Further vertical members can be provided in a stacked fashion, with the sockets of one vertical member receiving the projections of another vertical member, and two of the bolts having their stepped portions engaging the recesses of a shelf extending through the holes of the respective sockets and projections to lock the two vertical members together.

The legs of the vertical members are preferably interconnected by a pair of vertically spaced cross beams permanently fixed to the legs. The legs could further be provided with additional holes extending therethrough immediate the holes in their projections and sockets in order to be able to support a cross-member or shelf intermediate the projections and the sockets.

According to the first embodiment of the present invention, the cross-member comprises a first pair of horizontal beams interconnected by a second pair of horizontal beams extending perpendicular thereto. The rods forming the connectors are integral with the first pair of horizontal beams, extending from the ends thereof.

In both of the embodiments according to the present invention, the projections and the sockets preferably have complimentary cross-sections of a rectangular or square configuration.

According to a further feature of the present invention, the invention is simply made up of only three basic components, the vertical members, the cross-members or shelves, and the bolts or other suitable connectors.

BRIEF DESCRIPTION OF THE DRAWINGS

FIG. 1 is a side elevation of a storage rack assembly system in an assembled condition according to the present invention;

FIG. 2 is a side view of a vertical member according to the present invention;

DETAILED DESCRIPTION OF THE PREFERRED EMBODIMENTS

Figure 3:
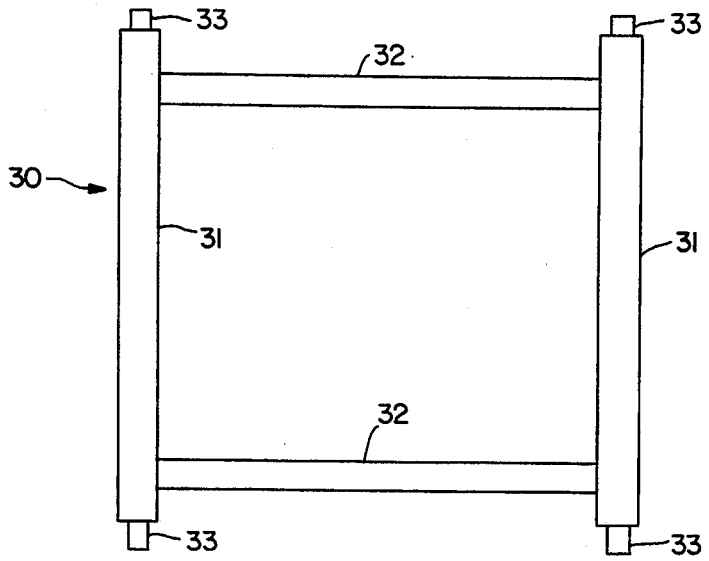
FIG. 3 is a plan view of a horizontal cross-member according to a first embodiment of the present invention.

The present invention provides a storage rack assembly system made up of relatively few components that are easily manually put together. Further, the present invention aims to provide a storage rack assembly system that can be assembled in a number of different configurations, as well as expanded in different directions, depending upon the desired use. Thus, the present invention provides storage rack units or shelving units that are vertically or horizontally repeatable.

In particular, and referring to FIG. 1, a storage rack assembly system 1 according to the present invention is made up of a plurality of vertical members 2 that can be stacked one on top of the other, and horizontal cross-members or shelves 3 that interconnect the vertical members 2 and provide horizontal surfaces for storage.

Referring now to FIG. 2, the vertical member 2 according to the present invention is made up of a pair of legs 21 that extend vertically and are interconnected at opposite ends thereof by cross beams 22. A diagonal brace 25 can also be provided to provide additional structural support. Each vertical member 2 is designed to be a separate integrated unit that is separable from the other units of the storage rack assembly. That is, the legs 21, cross beams 22 and brace 25 are permanently fixed to each other by any suitable means so as to form a single structural unit. For example, each vertical member could be made up of wooden beams glued or screwed to each other, or the vertical members 2 could be single molded units molded out of plastic so as to form each vertical member in a single piece. Of course, the vertical members 2 could also be made of other suitable materials such as steel or other metals, depending on the desired application of the storage rack assembly.

Each leg of each vertical member 2 has a projection 23 at one end thereof and a socket 24 at the opposite end thereof. The projections 23 are designed so as to be able to fit into the sockets 24 of another vertical member 2. Thus, as can be seen from FIG. 1, vertical members 2 can be stacked one on top of another so as to be able to vertically expand the storage rack assembly.

The projections 23 and the sockets 24 are both provided with holes 26 and are so designed that when the projections 23 are inserted into sockets 24 of another vertical member, the holes 26 are capable of being aligned for the insertion of a connector in the holes 26 to vertically lock the vertical members 2 together.

According to a first embodiment of the present invention, the cross members or shelves 3 are formed as cross members 30 illustrated in FIG. 3. These cross members 30 are made up first pair of beams 31 that are interconnected by a second pair of beams 32 extending substantially perpendicularly thereto and spacing the first pair of beams 31 apart. At each end of the first pair of beams 31 are provided rods 33 extending therefrom. The rods 33 are used as connectors for both interlocking the vertical members 2 and supporting the cross members 30 on the vertical members 2. Like the vertical members 2, the cross members or shelves 3 are designed to be separate integrated units, constructed of similar materials and methods similar to those of the vertical members 2.

Figure 4:
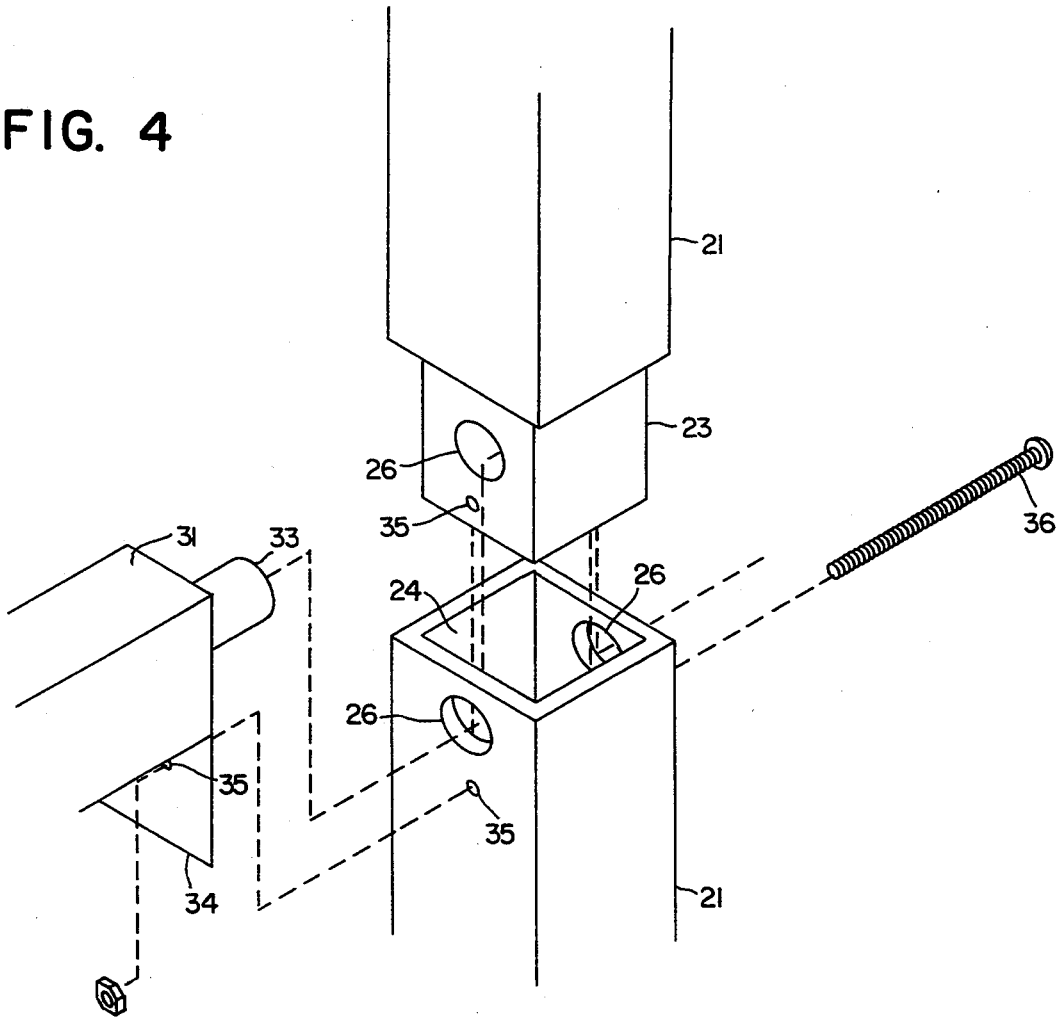
FIG. 4 is an exploded perspective view of a joint connecting two vertical members and a cross-member according to the first embodiment.

Noting FIG. 4, after the leg 21 of one vertical member 2, having a square projection 23 with the hole 26 extending therethrough, has been inserted into a similar square socket 24 of a leg 21 of another vertical member 2, so as to align the holes 26 of the socket 24 with the hole 26 of the projection 23, the rod 33 of the cross member 30 is inserted into the holes 26 of the socket 24 and the projection 23. This locks the socket 24 and the projection 23 together in the vertical direction, preventing removal of the vertical members 2 from each other. Thus, the rods 33 on each side of the cross member 30 connects a corresponding projections and sockets of two vertical members, and at the same time provide support for the cross member 30 on the vertical members 2.

Preferably, the rods 33 have a length no more than one half of the thickness of the leg 21 so that a rod 33 from two separate cross members 30 can be inserted into the same projection and socket joint from opposite sides thereof. This allows a storage rack assembly 1 according to the present invention to be horizontally expanded as well as vertically expanded. Note for example FIG. 1, wherein cross members or shelves 3 are connected on opposite sides of a single vertical member 2.

In the first embodiment according to the present invention, in order to ensure that the cross members 30 remain in the projection and socket joints, a flange 34 depending from each of the first pair of beams 31 adjacent the rod 33 can be provided. Each flange 34 is then provided with a bolt hole 35. Similar bolt holes 35 are provided through the sockets 24 and the projections 35 so as to allow a bolt 36 to secure the various elements together.

Of course, cross members 30 can also be connected to the upper end, at the socket 24, of the legs 21 of a vertical member 2, absent a further vertical member 2 stacked on top thereof. In this case, the rod 33 is simply inserted into the hole 26 of the socket 24 absent the presence of the projection 23 and its corresponding hole 26.

By the above arrangement, a storage rack assembly is provided which can be expanded both vertically and horizontally so as to provide as large or as small a storage rack as is desired. Further, referring again to FIG. 2, additional holes 26 can be provided in the legs 21 of the vertical member 2 intermediate the holes 26 of the sockets 24 and the projections 23. These additional holes 26 allow for the presence of intermediate cross members or shelves 3 to provide for additional shelving, as is illustrated in FIG. 1.

Preferably, the projections 23 and sockets 24 are of corresponding cross-sectional shapes, such as a rectangle or a square. However, of course, other suitable shapes could be provided. However, a square or rectangular cross-sectional shape ensures the proper orientation of the projections 23 and the sockets 24 upon connection.

A second embodiment according to the present invention will now be described with reference to FIGS. 5–9. Only the differences between the first embodiment and the second embodiment will be described. Similar features will not again be described in detail.

Figure 6:
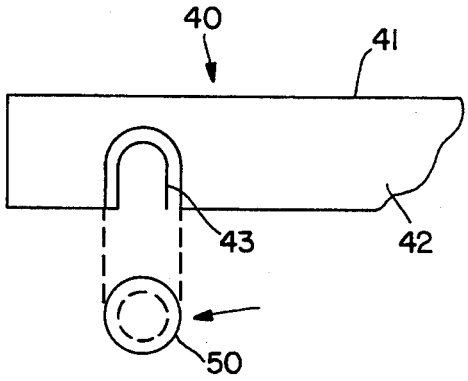
FIG. 6 is a partial side view of a detail of a shelf and hanger arrangement according to the second embodiment.
Figure 7:
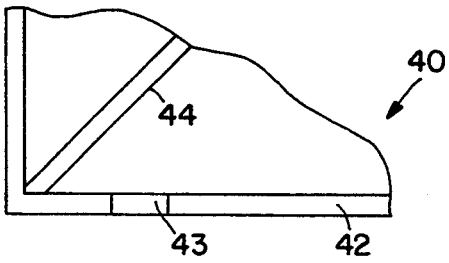
FIG. 7 is a partial view of a shelf according to the second embodiment seen from below.
Figure 5:
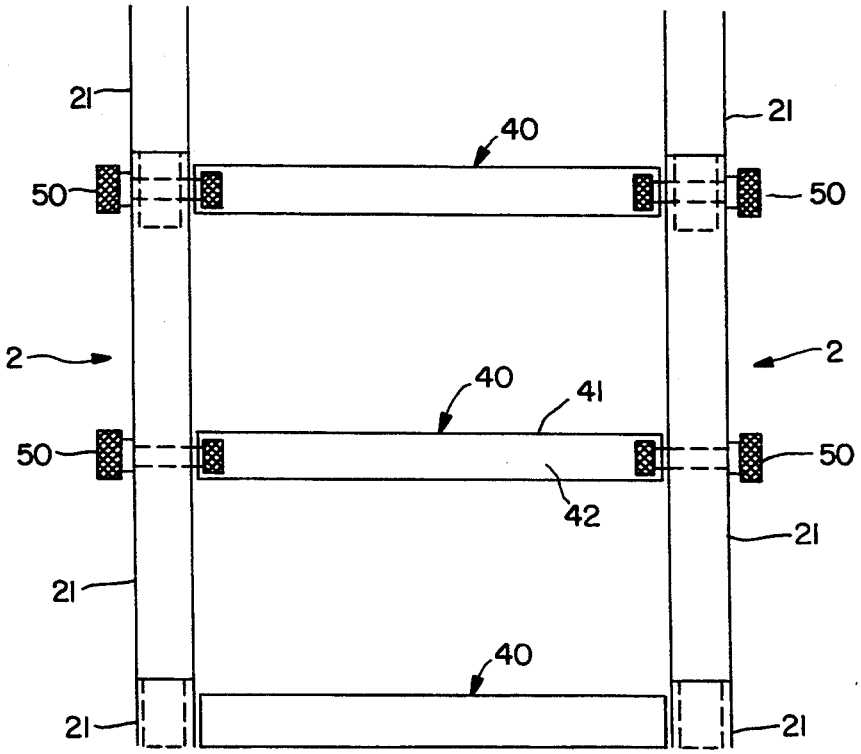
FIG. 5 is a partial side elevation of a storage rack assembly system according to a second embodiment of the present invention.

Referring first to FIG. 5, according to the second embodiment of the present invention, the cross members or shelves 3 are in the form of shelves 40. Referring to FIGS. 5–7 together, the shelves 40 have an upper surface 41 extending completely between the spaced vertical members 2, providing a solid upper support surface. In place of the rods 33 employed with the cross members 30 of the first embodiment, the present invention employs bolts 50 for connecting the stacked vertical members 2. The shelves 40 are provided with a plurality of bolt engaging portions formed as recesses 43 in a depending edge 42, the recesses 43 engaging the bolts 50 to support the shelves 40 on the vertical members 2. Noting FIG. 7, a support rib 44 can be provided on the underside of the shelves 40 to help provide a stronger structure for the shelves 40.

Figure 8:
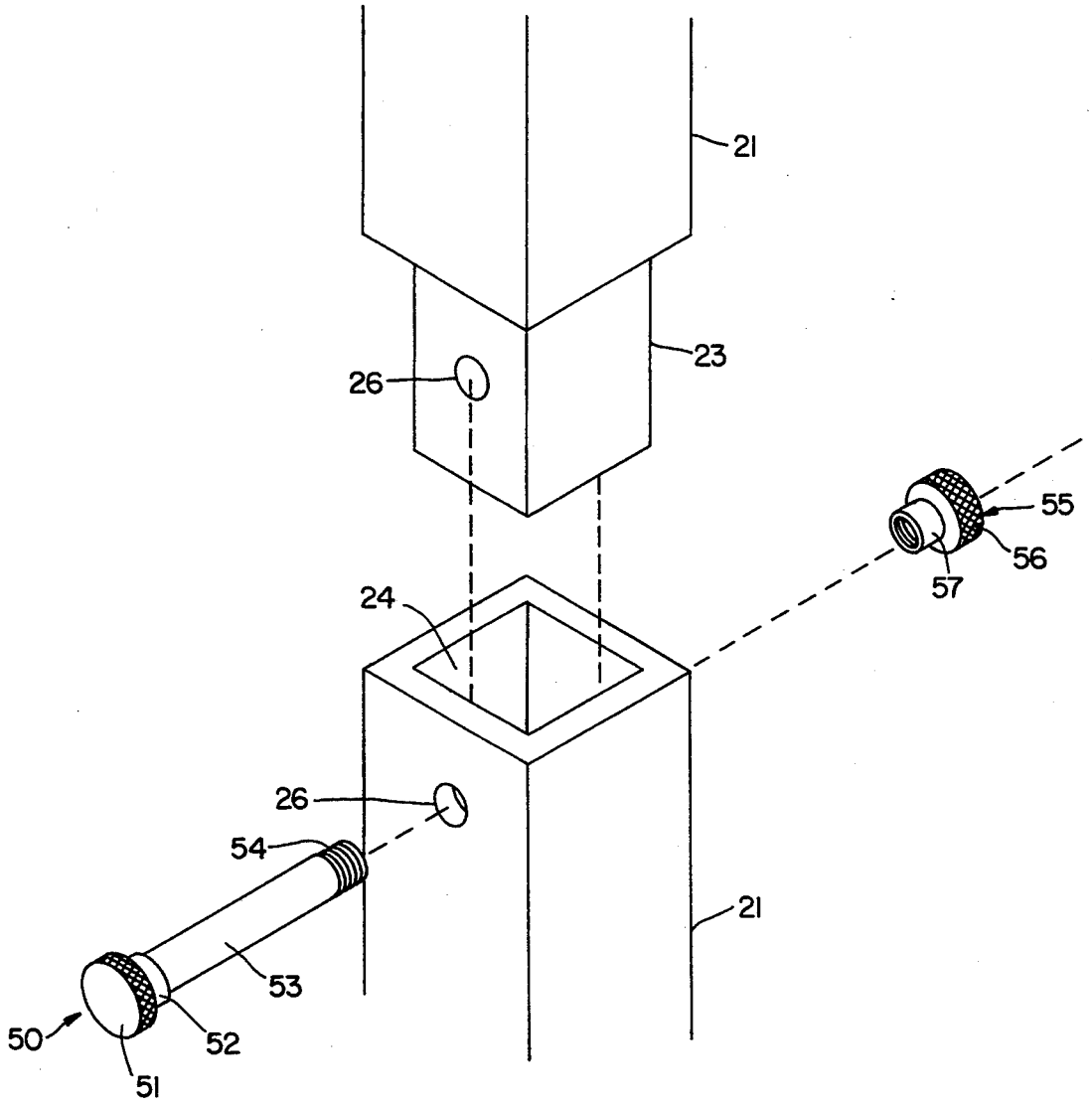
FIG. 8 is an exploded perspective view of a connection between two vertical members according to the second embodiment.

Referring now to FIG. 8, each bolt 50 comprises a head 51 provided adjacent to a smaller diameter stepped portion 52. The stepped portion 52 is provided with a smaller diameter than the head 51, but with a larger diameter than the holes 26. Adjacent to the stepped portion 52 is a shank 53 which has a diameter sized to fit through the holes 26. At the end of the shank 53 are provided threads 54. The bolt 50 is then inserted through the holes 26 of a socket 24 and a projection 23 to connect two vertical members 2 together. To secure the bolt, a nut 55 is threaded onto the threads 54. The nut 55 provides a similar, second head 56 with a similar stepped portion 57 having a diameter larger than the diameter of the holes 26.

Thus, as can be seen from FIG. 5, the bolts 50 extending through the holes 26 of the vertical members 2 provide stepped portions 52 and 57 for supporting the recesses 43 of the shelves 40.

Preferably, the heads 51 and 56 of the bolt and nut are knurled or roughened for easy manual assembly and disassembly.

Figure 9:
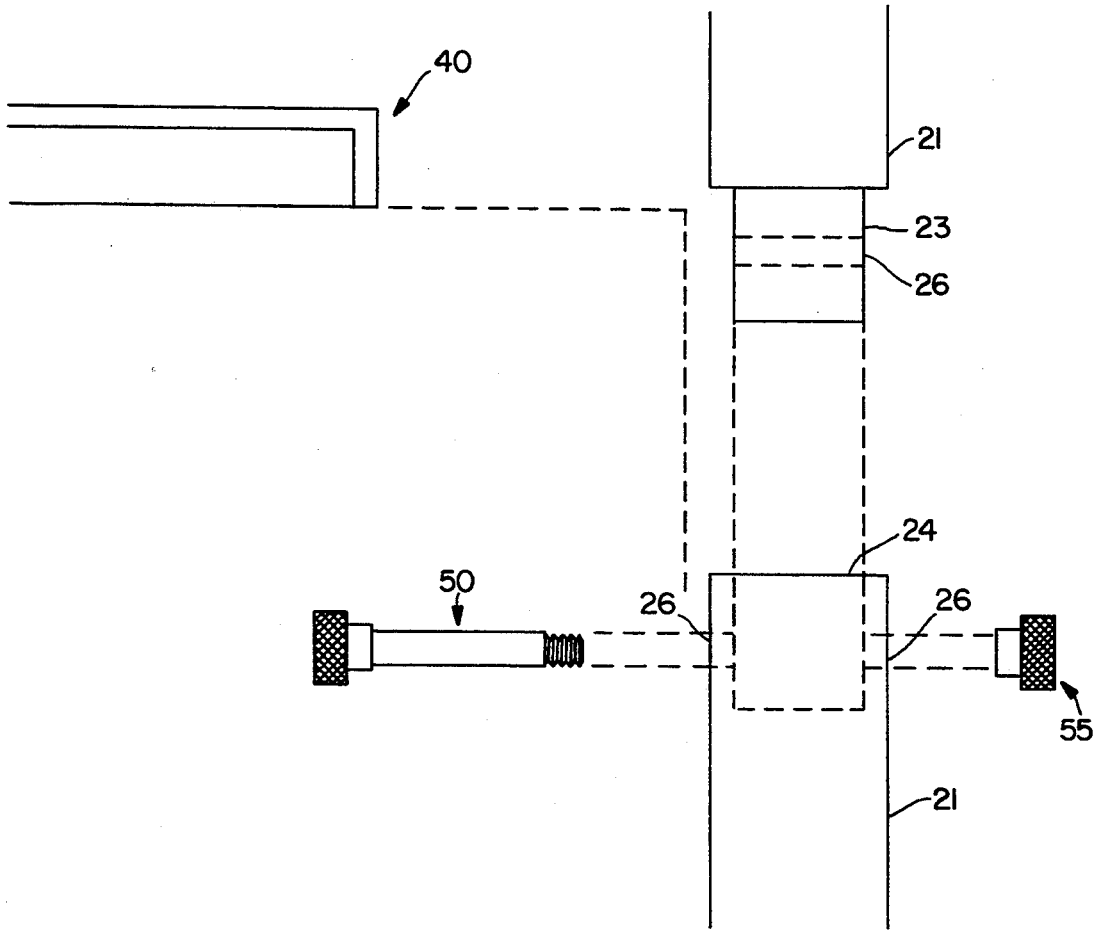
FIG. 9 is an exploded plan view of the joint connection according to the second embodiment of the present invention connecting two vertical members and a shelf together.

Attachment of the shelf 40 and connection of the joint can be further seen from FIG. 9, an exploded view of the connecting arrangement.

Thus, according to the second embodiment, a storage rack assembly system is provided in which only three basic types of components need be provided, the vertical members 2, shelves 40 and bolts 50. By the provision of a number of each of these components, a storage rack assembly can be provided which can be assembled into a number of different desired configurations. A storage rack can also be provided which is easily expandable or reconfigurable depending on the desired use. Similar to the first embodiment, as the bolts 50 provide a stepped portion on both sides thereof, the storage rack assembly according to the second embodiment is easily expandable both vertically and horizontally.

In the second embodiment, the bolt will preferably be made out of plastic, as is, preferably, the remainder of the structure. However, of course, depending on the application, other materials, such as metal, may be used. For example, for heavy applications, steel components employing hex head bolts can be used.

Thus, in accordance with the present invention, a storage rack assembly system has been provided which can provide shelving units in home settings, for organizing closet space as well as providing free standing shelving. The storage rack assembly system could also be used in the garage, or even for industrial shelving if made out of suitable strength materials such as steel.

The storage rack assembly system according to the present invention has been described with reference to preferred features and embodiments thereof. However, it will be understood the various changes and modifications may be made without departing from the spirit and scope of the present invention.

I claim:

1. A storage rack assembly system, comprising:

a plurality of vertical members, each said vertical member having a pair of legs that are interconnected to form a structural unit, a projection at one end of each said leg and a socket at an opposite end of each said leg, said projections of each said vertical member being adapted to fit into said sockets of another said vertical member, and both said projections and said sockets of each said vertical member having through holes extending laterally therethrough and positioned so as to be alignable when said projections of one said vertical member are in said sockets of another said vertical member;

a plurality of cross-members adapted to be horizontally supported between pairs of said vertical members so as to provide a horizontal support surface; and a plurality of connectors adapted to be inserted in said through holes of said sockets and said projections and to support said cross-members on said vertical members;

wherein said connectors are bolts and said cross-members are shelves, each said shelf comprising a horizontal surface having a downwardly extending edge, and said edge of each said shelf having recesses therein for engaging said bolts.

2. The storage rack assembly system of claim 1, wherein said bolts are longer than the width of said sockets of said vertical members so as to be able to extend completely through said holes extending laterally through said sockets, each said bolt having a head at one end thereof, a stepped portion adjacent to said head having a larger diameter than said holes through said sockets and said projections, a shank having a diameter sized to fit through said holes through said sockets and said projections, a threaded end on said shank and a nut, said nut comprising a second head and a second stepped portion adjacent to said second head having a larger diameter than said holes through said sockets and said projections.

3. The storage rack assembly system of claim 1, wherein said legs of said vertical members are interconnected by a pair of vertically spaced cross beams permanently fixed to said legs.

4. The storage rack assembly system of claim 1, wherein each said projection and each said socket have a complementary rectangular cross-section.

5. A storage rack assembly system, comprising:

a plurality of vertical members, each said vertical member having projections at one end thereof and sockets at an opposite end thereof, said projections of one said vertical member being adapted to fit in said sockets of another said vertical member, and both said sockets and said projections having holes extending laterally therethrough positioned so as to be alignable when said projections of one said vertical member are in said sockets of another said vertical member;

a plurality of shelves adapted to be horizontally supported between a pair of said vertical members so as to provide a horizontal support surface, each said shelf having a plurality of bolt engaging portions thereon; and a plurality of bolts adapted to extend through said holes in said sockets and projections and adapted to support said shelves.

6. The storage rack assembly system of claim 5, wherein each said shelf comprises a horizontal surface having a downwardly extending edge, said bolt engaging portions of said shelves being recesses formed in said edges of said shelves.

7. The storage rack assembly system of claim 6, wherein said bolts are longer than the width of said sockets of said vertical members so as to be able to extend completely through said holes extending laterally through said sockets, each said bolt having a head at one thereof, a stepped portion adjacent to said head having a larger diameter than said holes through said sockets and said projections, a shank having a diameter sized to fit through said holes through said sockets and said projections, a threaded end on said shank and a nut, said nut comprising a second head and a second stepped portion adjacent to said second head having a larger diameter than said holes through said sockets and said projections.

8. The storage rack assembly system of claim 7, wherein said plurality of vertical members includes a first said vertical member having four said bolts extending through said holes thereof and a second said vertical member having four said bolts extending through said holes thereof, and said plurality of shelves includes a first shelf having said recesses thereof engaging two said stepped portions of said bolts on each of the first and second said vertical members and a second shelf having said recesses thereof engaging two said stepped portions of said bolts on each of the first and second said vertical members.

9. The storage rack assembly system of claim 8, wherein said plurality of vertical members further includes a third said vertical member engaged with one of said first and second vertical members such that said sockets of one said vertical member receive said projections of the other said vertical member and two of said bolts having said stepped portions thereof engaged with said recesses of a said shelf extend through the said holes of the respective said sockets and projections to lock said third vertical member with the one of said first and second vertical members.

10. The storage rack assembly system of claim 7, wherein said assembly system consists of said vertical members, said shelves and said bolts.

11. The storage rack assembly system of claim 7, wherein said heads of said bolts and said second heads of said nuts are knurled.

12. The storage rack assembly system of claim 5, wherein each said vertical member has an additional pair of holes extending therethrough intermediate said holes in said projections and said sockets so as to be able to support a said shelf intermediate said projection and said sockets.

13. The storage rack assembly system of claim 5, wherein each said vertical member comprises a pair of legs, each said leg having a said projection at one end thereof and a said socket at another end thereof, and a pair of cross beams permanently connected to and spacing apart both said legs.

14. The storage rack assembly system of claim 13, wherein each said shelf is a unitary member having a horizontal surface with a downwardly extending edge, said bolt engaging portions of said shelves being recesses formed in said edges of said shelves.

* * * * *